United States Patent [19]

Dickerson et al.

[11] Patent Number: 4,533,439

[45] Date of Patent: Aug. 6, 1985

[54] APPARATUS AND METHOD OF USING A FUEL GAS REGULATOR FOR A COKE OVEN BATTERY

[75] Inventors: Douglas M. Dickerson, Pleasant Grove; Robert W. Fikes, Cottondale Township, Tuscaloosa County, both of Ala.

[73] Assignee: United States Steel Corporation, Pittsburgh, Pa.

[21] Appl. No.: 499,071

[22] Filed: May 27, 1983

[51] Int. Cl.[3] ..... C10B 21/10

[52] U.S. Cl. ..... 201/41; 126/285 R; 202/151; 202/270; 431/12; 432/26; 432/189

[58] Field of Search ..... 202/151, 239, 269, 270; 201/41; 236/1 G; 239/461, 499, 504; 432/26, 198; 137/625.48; 126/285 R, 285 B; 431/12, 189, 346

[56] References Cited

U.S. PATENT DOCUMENTS

| | | | |
|---|---|---|---|
| 287,964 | 11/1883 | Rickel et al. | 126/285 R |
| 495,648 | 4/1893 | Zerban | 126/285 R |
| 2,970,949 | 2/1961 | Thompson, Jr. | 202/151 |
| 3,934,796 | 1/1976 | Smith, Jr. et al. | 126/285.5 |
| 4,005,820 | 2/1977 | Cress | 236/1 G |
| 4,046,318 | 9/1977 | Ripley | 236/1 G |
| 4,406,396 | 9/1983 | Habegger | 236/1 G |

FOREIGN PATENT DOCUMENTS

| | | | |
|---|---|---|---|
| 508894 | 10/1952 | France | 202/151 |
| 1340920 | 12/1973 | United Kingdom | 202/138 |

*Primary Examiner*—Peter Kratz
*Assistant Examiner*—Mike McGurk
*Attorney, Agent, or Firm*—George D. Dickos

[57] ABSTRACT

Method and apparatus for the regulation of the flow of fuel gas in the fuel gas supply duct of a heating wall of a coke oven to assure uniform heat distribution in the oven are provided. The regulating means consists of a thin plate having a similar shape to that of a fuel gas supply duct for insertion therein. Pivotally attached to and extending perpendicularly from the outer face of the plate are twin parallel control rods with gage marks inscribed thereon. To effect the regulation of fuel gas flow, the regulating means is inserted into the fuel gas supply duct at an appropriate location and the flow rate is adjusted by pivoting the plate by the manipulation of the adjusting rods.

8 Claims, 3 Drawing Figures

I
30
62
20
III
III
28
51
40
41
42
44
50
80
66
64
49
I 14
22
34
60
76
64
78
66
62
70
68
67
65
74
72

APPARATUS AND METHOD OF USING A FUEL GAS REGULATOR FOR A COKE OVEN BATTERY

BACKGROUND OF THE INVENTION

The present invention relates to the regulation of gas flow within a conduit and, in particular, to the regulation of fuel gas flow within the fuel gas supply duct of a heating wall of a coke oven battery.

During the operation of a coke oven battery to produce coke for various purposes, a serious problem which arises is the loss of heat from the battery by radiation and especially from the ends of the battery. This problem is particularly manifested in the loss of heat from the ends of the ovens due to radiation from the outer surfaces of the end heating flues. As such, the end heating flues of the oven typically become cooler than the remaining oven heating flues. This problem is particularly attenuated when a coke oven battery is operated during a slowdown period or other period of reduced operation. During such reduced operations, the condition of lower temperature in the end flues of the heating wall is worsened due to the gas flow within the fuel gas supply duct being supplied under reduced pressure. This causes a lesser amount of fuel than is necessary to avoid a harmful temperature gradient to be provided to such end flues. Of most serious concern is the situation in which the coke oven battery is maintained in an "idle-hot" condition, that is, the oven is maintained heated but no coke is charged into the oven for production. During such idle-hot conditions, the fuel gas supplied by the fuel gas supply duct is much less than the oven was intended to accommodate and hence even less fuel gas is supplied to the end flues causing an even lower temperature in the end heating flues.

Various problems may arise due to the maintenance of an excessively low temperature in the end flues of a coke oven heating wall. For example, the temperature within the end heating flues may be insufficient to cause the intended ignition of the fuel gas. As such, fuel gas may collect in an area of lower temperature and then move into a higher temperature area causing the spontaneous ignition of an excessive amount of fuel gas resulting in a severe explosion within the heating flue with most disasterous consequences. Another problem which arises is damage to the refractory materials which form the heating flues of the oven due to the temperature thereof dropping below a critical point. The great expense necessary to correct such refractory damage must be immediately borne in order to avoid atmospheric pollution which may escape via cracks in the refractory and to maintain the structural integrity of the battery. A related problem is that due to the excessive temperature gradient between the end flues and the various other flues of the heating wall, the refractory materials may also become cracked or otherwise damaged also causing leakage of pollutants to the atmosphere and necessitating costly repair.

From the above, it is apparent that the likelihood of coke oven explosion and/or refractory damage during idle-hot operations is most significant. The current method of alleviating this problem in many coke ovens is to increase the flow of fuel gas to all heating flues to maintain the temperature in the end flues at a level sufficient to ignite all fuel gas and to prevent refractory damage due to contraction beyond a critical point. However, an excessive temperature gradient may still exist within the flues of each wall even when gas flow is increased.

Accordingly, it is an object of this invention to provide an apparatus and method for regulating the flow of fuel gas within the fuel gas supply duct of a coke oven to supply additional fuel gas to the end leaking flues in order to maintain a consistent temperature across the heating wall of a coke oven and avoid the unnecessary utilization of fuel gas.

It is another object of the present invention to provide an apparatus to regulate the flow of fuel gas within the fuel gas supply duct to provide for relatively balanced heating of the heating wall during slow-down operations of a coke oven battery.

While previous attempts have been made to alleviate the above-enumerated problems, no prior method or apparatus achieves all of the advantages of those of the present invention. One example of a prior attempt to deal with uneven coke oven heating during a slowdown in operations appears in U.S. Pat. No. 2,970,949 issued to Ernest Thompson, Jr. That patent teaches the use of a complicated fuel gas flow control insert. That device is intended to be positioned within the fuel gas supply duct of a coke oven heating wall and the design includes a bulky horizontal member of substantial length which includes an upward extending portion and a fixed, downward extending baffle. The Thompson apparatus requires that the horizontal member be supported by elongated parallel bars which must be affixed to a metallic liner within the fuel gas supply duct. That apparatus is intended to be positioned at various locations within the fuel gas supply duct to simply block fuel gas flow along the duct length to direct additional fuel gas into the end heating flues. In one embodiment of his invention, Thompson provides for a fuel gas control insert which includes a rotatable portion of the baffle in place of the completely fixed baffle. The problems with the Thompson design are first that it is not suitable for application in all types of coke ovens which employ a fuel gas supply duct or gun. For example, coke ovens of the Carl-Still design have only a small narrow aperture through the buckstays which communicates with the fuel gas supply duct. The fuel gas control means described by Thompson would certainly not be able to be inserted into such a coke oven design. In addition, the Thompson design provides a bulky, difficult to control means for regulating fuel gas supply which is only able to either redirect the fuel gas flow without allowing variation in flow rate or to only allow a minor variation in flow rate. Moreover, the complicated design of the '949 patent is most difficult to install and is costly and inefficient.

Another form of fuel gas supply regulator which has been employed in the fuel gas supply duct of a coke oven comprises a circular disc which is welded to the end of an extended rod for insertion into the fuel gas supply duct of, for example, a Koppers-Becker type coke oven battery. Such a design suffers from certain shortcomings similar to that of the Thompson apparatus. For example, since the flow control baffle in the latter-mentioned design is welded to the insertion rod, it is also not possible to pass such an apparatus through the narrow opening in the end of the fuel gas supply duct of a Carl-Still type battery. In addition, such a fuel gas control insert is not able to be manipulated within a fuel gas control duct so as to allow any variation in fuel gas flow. That is, the latter type of control means only provides a rigid baffle to redirect the fuel gas flow rather than that of the present invention which allows complete flexibility in flow control.

The subject invention is directed toward an improved means for regulating the flow of fuel gas within the fuel gas supply duct of a coke oven which overcomes, among others, the above-discussed problems and provides a control apparatus which is effective in the complete regulation of flow within the fuel gas supply duct of a coke oven while being of an uncomplicated, inexpensive, easy to install and useful design.

SUMMARY OF THE INVENTION

In accordance with the present invention, there is provided method and apparatus for the control of the flow of fluid within a conduit and, in particular, to control the flow of fuel gas within the fuel gas supply duct so as to direct additional fuel gas to the end flues of a coke oven to provide uniform heating of such oven especially during periods of slowdown or idle-hot operations. The apparatus provided for regulating the fuel gas flow within the fuel gas supply duct of a heating wall of a coke oven battery consists of a heat-resistant plate or sheet of similar, yet slightly smaller, peripheral dimensions as the inside cross-sectional surface of the fuel gas supply duct at the point at which flow regulation is intended. This design is intended to allow the insertion of the plate within the fuel gas supply duct. In order to accomplish the insertion of the aforementioned plate into the fuel gas supply duct, the positioning of the plate, and the adjustment of the attitude of the plate within the duct, dual control rods are provided. One end of each control rod is pivotally affixed to the face of the plate nearest the outside of the coke oven battery by means of brackets. The control rods are intended to be of a length sufficient to allow manipulation of the plate from a control point remote from the coke oven battery.

In order to accommodate the regulation of the flow of fuel gas within the fuel gas supply duct, the plate is inserted into the fuel gas supply duct to a position effective to direct the fuel gas into the desired end heating flues by means of the control rods. In order to vary the flow of fuel gas within the fuel gas supply duct, the attitude of the plate is able to be manipulated by varying the relative displacement of the control rods within the fuel gas supply duct. This accomplishes the pivoting of the plate about its axis within the duct.

Test results indicate that the utilization of the device herein provided may reduce the fuel gas input which must be supplied to the heating flues to avoid the possibility of explosion or refractory damage due to cooling by approximately fifteen percent (15%) while also avoiding an excessive temperature gradient between flues. On a typical battery, these savings may translate into over five hundred thousand dollars ($500,000.) per battery per year.

Accordingly, the present invention supplies solutions to the aforementioned problems present in the operation of a coke oven battery. As this invention provides an efficient, cost-effective means of regulating the flow of fuel gas within the fuel gas supply duct of a heating wall of a coke oven battery, complete regulation of such flow may be accomplished in order to more efficiently and safely operate a coke oven.

These and other details, drawings and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE INVENTION

Figure 1:
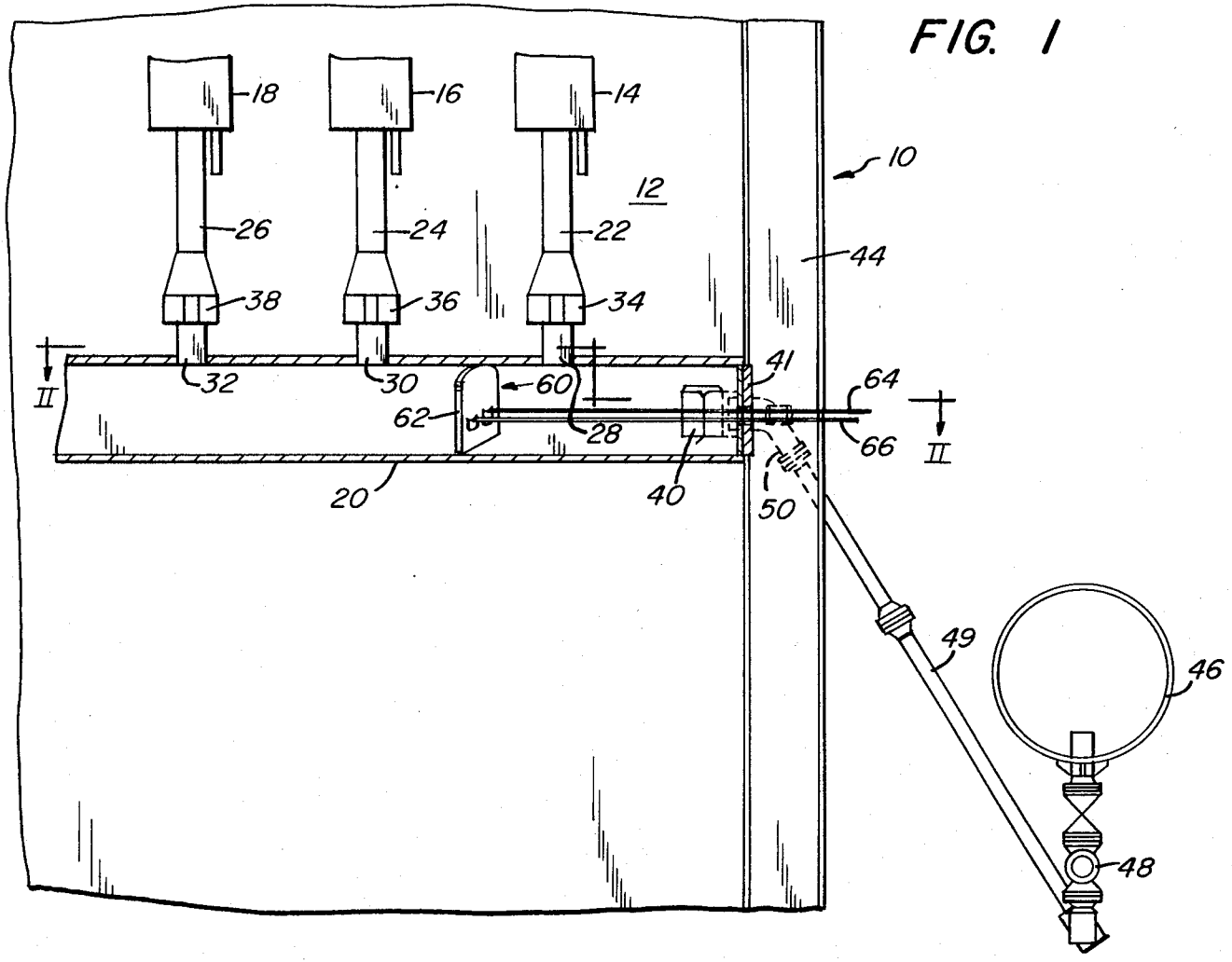
FIG. 1 is a cross-sectional side view of a coke oven heating wall in which the herein provided device has been installed.
Figure 2:
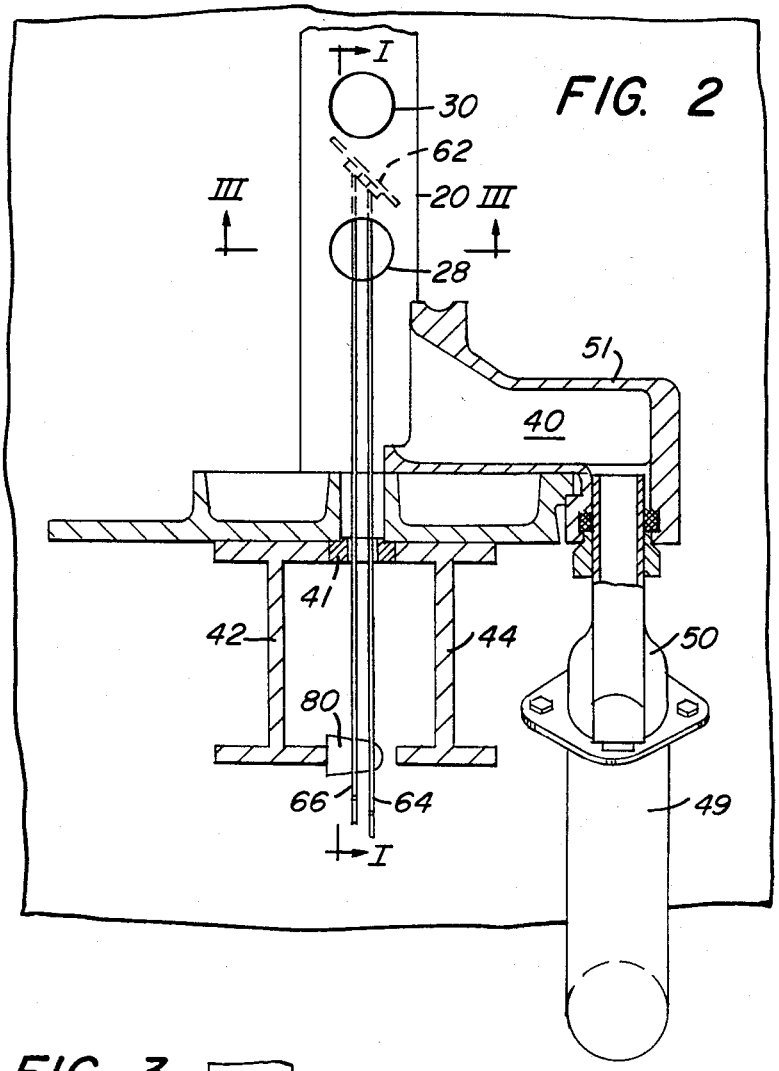
FIG. 2 is a top cross-sectional view of the fuel gas supply duct inlet area of a coke oven heating wall utilizing the present invention; and, FIG. 3 is an end view of the fuel gas control provided herein in place within a fuel gas supply duct with the control rods shown in perspective for illustration purposes only.
Figure 3:
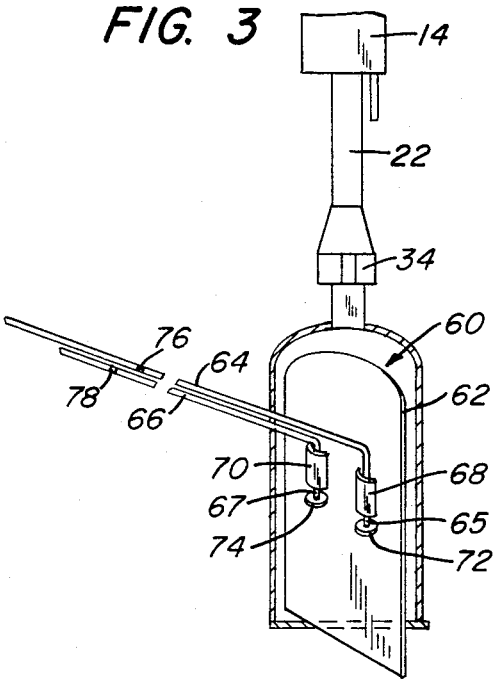

Referring now to the drawings wherein the showings are for purposes of illustrating the present preferred embodiment of the invention only and not for purposes of limiting same, the figures show a coke oven battery 10 having generally shown a portion of heating wall 12. The heating wall 12 includes a plurality of vertical flues, with the endmost flue designated 14 and the adjacent inner flues 16 and 18, respectively. The vertical flues 14, 16 and 18 are provided with fuel gas from a fuel gas supply duct 20 by means of vertical ducts 22, 24 and 26, respectively, in communication with the lower portion of each such flue. The fuel gas is supplied to vertical ducts 22, 24 and 26 from supply duct 20 by means of openings 28, 30 and 32, respectively, in duct 20, such openings having gas proportioning nozzles 34, 36 and 38, respectively, positioned therein. Fuel gas supply duct 20 is provided with end cover 41 having an aperture therethrough which cover fits between the closely spaced coke oven buckstays 42 and 44 and is bolted to the coke oven 10. The source of fuel gas, the fuel gas supply main 46, communicates with the fuel gas supply duct 20 by means of, first, valve means 48, then fuel gas riser 49, elbow 50 and finally gas inputing casting 51 which contains gas passageway 40.

Fuel gas control device 60 is intended to be placed within fuel gas supply duct 20 through the outer end cover 41. As was indicated above, the fuel gas supply duct end cover 41 which provides the access passageway to the fuel gas supply duct 20 may be quite narrow. An additional impediment to access to the gas supply duct 20 is the narrow clearance between buckstays 42 and 44.

The fuel gas control device 60 consists of a plate 62 of rigid sheet material, preferably steel approximately one-fourth ($\frac{1}{4}$) inch thick, of peripheral dimensions similar to, but slightly smaller than, the inside cross-sectional surface of the fuel gas supply duct 20 in the area in which fuel gas flow control is desired. Typically, the fuel gas control device 60 will be placed in the duct 20 between the endmost flues. Preferably, the device 60 will be positioned between end flue 14 and the adjacent flue 16. As the cross-section of the fuel gas supply duct 20 is tapered to a smaller cross-section from the outer portion of coke oven 10 inward, the outer dimensions of plate 60 should be determined to provide minimal clearance with duct 20 at the particular location intended. For example, if the inner cross-sectional surface of fuel gas supply duct 20 were eight and one-fourth ($8\frac{1}{4}$) inches high by five and three-fourths ($5\frac{3}{4}$) inches wide, the plate 60 would preferably be eight (8) inches high by four and three-fourths ($4\frac{3}{4}$) inches wide to provide a clearance of one-half (½) inch on each of the sides and one-fourth (¼) inch on the top about plate 62.

In order to insert, position and adjust plate 62 within fuel gas supply duct 20, dual positioning rods 64 and 66, respectively, of approximately three-eighths (⅜) inch in diameter and of a length sufficient to accomplish flow control from a position remote from the duct 20 are provided to be pivotally affixed to plate 62 by means of downward extending portions 65 and 67 of rods 64 and 66, respectively. The extensions 65 and 67 are affixed to plate 62 by means of brackets 68 and 70, respectively, which are attached, e.g. by welding, to the face of plate 62 nearest the outside of coke oven battery 10. Retaining means 72 and 74 may comprise nuts or washers and are secured to the lower part of extensions 65 and 67, respectively, to prevent disattachment of rods 64 and 66 from plate 62. Gage marks 76 and 78 may be inscribed at equidistant points on control rods 64 and 66, respectively, in order to ascertain the position and attitude of plate 62 within fuel gas supply duct 20. In order to secure plate 62 following its positioning and adjustment within fuel gas supply duct 20, a "U"-bolt 80 may be welded to buckstay 42 to withhold rods 64 and 66.

In order to install fuel gas control device 60 in fuel gas supply duct 20 during periods during which fuel gas is not flowing within duct 20, the end cover 41 of the fuel gas supply duct 20 must first be removed. At that point, fuel gas control device 60 may be inserted into fuel gas duct 20 by means of control rods 64 and 66 to the point therein at which fuel gas flow control is desired. As indicated above, this position will preferably be between flues 14 and 16, but it is to be understood that with proper sizing of plate 62, device 60 may be inserted at any point along duct 20. The attitude of plate 62 is then adjusted by manipulation of rods 64 and 66. The displacement of either rod 64 or 66 further into or out of fuel gas supply duct 20 will cause the side of plate 62 to which such rod is attached to be pivoted either further into or out of duct 20, respectively, and thus rotate plate 62 about its vertical axis. The fuel gas supply duct 20 is then closed from the atmosphere by slipping end cover 41 over the ends of control rods 64 and 66 which extend from duct 20 such that rods 64 and 66 pass through the aperture in fuel gas duct end cover 41. The aperture in cover 41 is sealed from the atmosphere by means of a suitable sealing material such as silicone. The ends of control rods 64 and 66 are then secured in position by means of "U-bolt" 80 affixed to buckstay 42.

Should adjustment of the position or attitude flow control device 60 be desired, the control rods 64 and 66 are released from "U-bolt" 80, the position and/or attitude adjusted by rods 64 and 66 and the rods resecured to "U-bolt" 80. At that point it is also preferable to re-seal the aperture in end cover 41.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A method for regulating the flow of fuel gas within the fuel gas supply duct for a coke oven heating wall having a plurality of vertical heating flues in communication with said fuel gas supply duct, said fuel gas supply duct having a passage therethrough of a predetermined cross-sectional shape, which duct is provided with an opening in the end thereof, from a position remote from said duct, which comprises:

a. inserting into said fuel gas supply duct a plate formed of heat-resistant sheet material, the shape of said plate being substantially that of the cross-sectional shape of said plate having at least two elongated control rods connected thereto, said control rods each extending from said remote position through said opening and having one of their ends pivotally attached to said plate at spaced points thereon;

b. adjusting the longitudinal position of said plate within said fuel gas supply duct by manual manipulation of said control rods so as to direct the flow of said fuel gas to a desired area of said ducts; and, c. adjusting the positional attitude of said plate relative to the wall of said duct by manual manipulation of the relative displacement of said control rods within said control duct so as to rotate said plate about the axis of rotation formed between the ends of said control rods attached to said plate so as to regulate the amount of fuel gas passing said plate within said duct.

2. The method of claim 1 in which the position of said plate is adjusted to be near the end of said duct nearest said remote position.

3. The method of claim 2 in which the position of said plate within said fuel gas supply duct is adjusted to be between the outermost flue and the adjacent flue.

4. Apparatus for regulating the flow of fuel gas within a heating wall of a coke oven, comprising:

a. a fuel gas supply duct disposed within and extending substantially the length of said heating wall, said fuel gas supply duct having a passage therethrough of a predetermined cross-sectional shape, said fuel gas supply duct being provided with an opening in an end thereof;

b. a plate formed of heat-resistant sheet material disposed within said passageway, the shape of said plate being substantially that of the cross-sectional shape of said passageway; and, c. at least two elongated control rods, each of said rods having one of their ends attached by a pivotable means to said plate at spaced points thereon, said control rods extending to a remote position exteriorly of said fuel gas supply duct through said opening, said control rods being adapted to manipulate the longitudinal position of said plate within said passageway and the positional attitude of said plate relative to the interior wall of said passageway.

5. Apparatus of claim 4 in which said control rods are attached to said plate so as to extent perpendicularly therefrom.

6. Apparatus of claim 5 which said pivotable means comprises:

a. extensions to the ends of each of said control rods attached to said plate, said extensions extending parallel to the axis of rotation of said plate; and, b. brackets affixed to the face of said plate to pivotally receive said extensions.

7. Apparatus of claim 6 in which the axis of rotation of said plate is its vertical axis.

8. Apparatus of claim 7 in which said control rods each have gage marks thereon in order to ascertain the relative position of said control rods to one another and the position of said control rods relative to a fixed location.

* * * * *